United States Patent [19]

MacDonald

[11] Patent Number: 4,967,453

[45] Date of Patent: Nov. 6, 1990

[54] RESILIENT CLIP

[76] Inventor: Sumner B. MacDonald, 285 North Farm Dr., Bristol, R.I. 02809

[21] Appl. No.: 345,946

[22] Filed: May 1, 1989

[51] Int. Cl.[5] ..... B42F 1/02

[52] U.S. Cl. ..... 24/530; 24/67.3; 150/137

[58] Field of Search ..... 24/530, 545, 563, 67.4, 24/67.9, 67.11, 67 R, 900, 459; 150/137

[56] References Cited

U.S. PATENT DOCUMENTS

| | | | |
|---|---|---|---|
| 386,513 | 7/1888 | Weeks | 24/67.11 |
| 613,890 | 11/1898 | Simmons | 24/530 X |
| 1,405,024 | 1/1922 | Smith et al. | 24/67.11 |
| 1,869,032 | 7/1932 | Van Buren | 24/67.3 |
| 3,049,772 | 8/1962 | Anderson . | |
| 3,141,213 | 7/1964 | Rinaldi | 24/67.3 X |

FOREIGN PATENT DOCUMENTS

| | | | |
|---|---|---|---|
| 636630 | 2/1962 | Canada | 24/530 |
| 1001037 | 12/1976 | Canada | 24/67 R |
| 1129010 | 5/1962 | Fed. Rep. of Germany | 24/530 |
| 1191942 | 4/1965 | Fed. Rep. of Germany | 24/67.3 |
| 1159029 | 6/1958 | France | 24/530 |

*Primary Examiner*—James R. Brittain

[57] ABSTRACT

A clip having a spring member held at its ends between the edges of a hole in a first wall member and a stop member attached to the first wall member, the clip having a second wall member that is spaced from the first wall member.

4 Claims, 1 Drawing Sheet

RESILIENT CLIP

FIELD OF THE INVENTION

The invention relates to devices for releasably retaining flat objects.

1. Background of the Invention

It is known to releasably retain flat objects such as paper currency between a fixed member and a spring member of a clip and to secure a spring member within a clip by placing the spring member between a tongue of a first portion and a square-shaped hole of a second portion, as in Anderson U.S. Pat. No. 3,049,772, "Necktie Clasp", granted Aug. 31, 1962.

2. Summary of the Invention

I have discovered that such a clip desirably has a spring member held at its end between the edges of a hole in a spring housing and stop means.

In preferred embodiments the spring member is flattenable in use and movable then with respect to the hole edges, a housing wall toward which the spring member is biased is movable relative to the hole edges in use, the housing is of metal, and the stop means are portions of a plastic cap riveted to the housing means.

PREFERRED EMBODIMENT

The presently preferred embodiment is as follows.

DRAWINGS

STRUCTURE

Figure 1:
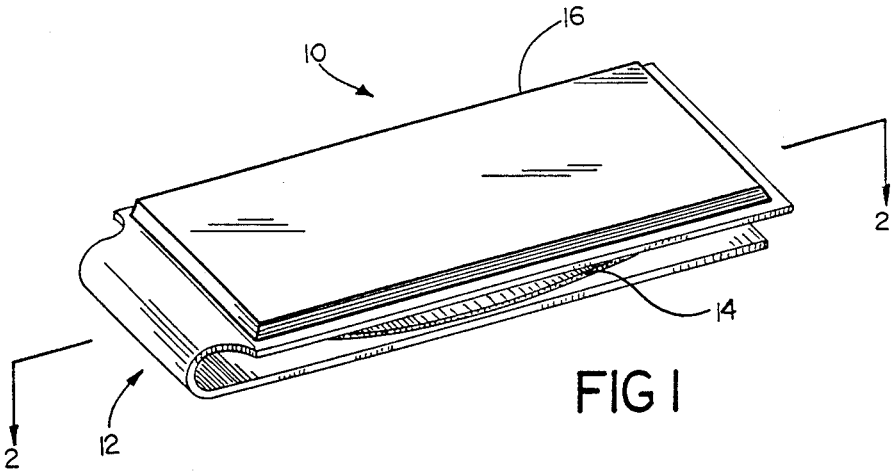
FIG. 1 shows a perspective view of a clip according to the present invention.
Figure 2:
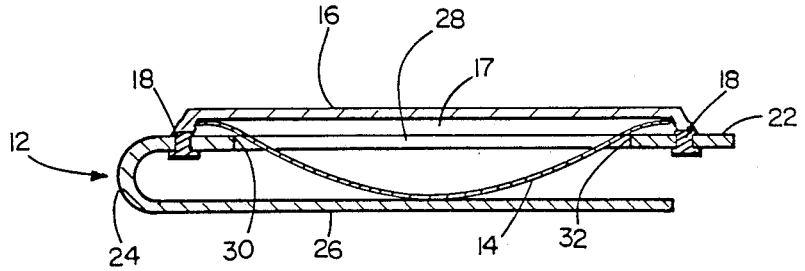
FIG. 2 shows the FIG. 1 clip shown along the lines 2—2.

Referring to FIGS. 1 and 2, clip 10 includes metal housing 12, steel spring member 14 and plastic top structure 16 having a recess 17. Top structure 16 is attached to support structure 12 by plastic rivets 18 which are ultrasonically welded or staked to corresponding holes of support structure 12.

Support structure 12 includes top portion 22, bottom portion 24 and connecting portion 26. Top portion 22 defines hole 28 having opposing surfaces 30, 32. Spring member 14 is resiliently mounted between opposing surfaces 30, 32 as well as between top portion 22 and the top of recess 17 of top structure 16.

OPERATION

Referring to FIGS. 1 and 2, clip 10 is constructed by riveting top structure 16 to support structure 12, slipping spring member 14 between top portion 22 and bottom portion 24 such that one end of spring member 14 contacts opposing portion 30 and the top of recess 17. Spring member 14 is then biased until the other end can slip past portion 32. This end is then released allowing spring member 14 to exert a force against opposing portions 30, 32, bottom portion 24 and the top of recess 17.

In operation, a flat object, e.g., paper currency, is releasably retained between spring member 14 and bottom portion 24. Also, top structure 16 may easibly be removed for engraving. Additionally, information, e.g., advertising, may be printed on top structure 16.

What is claimed is:

1. A clip for releasably retaining a flat object comprising opposing first and second elongated wall members that are connected to each other at one end only and spaced from each other so as to define a flat region therebetween for receiving said flat object, said first wall member having a first surface and a second surface, said second surface facing said second wall member, said first wall member having an elognated hole through it with edges at two ends, a stop member connected to said first wall member and spaced from said first surface, and an elognated spring member having a middle portion that extends between said two edges of said hole toward said second wall member, said elongated spring member also having ends held between said edges and said stop member.

2. The apparatus of claim 1 wherein said spring member is flattenable and movable with the respect to said hole edges.

3. The apparatus of claim 1 wherein said first and second wall members are made of metal.

4. The apparatus of claim 1 wherein said stop member is a plastic cap riveted to said spring housing.

* * * * *